United States Patent [19]

Hart et al.

[11] 3,985,078

[45] Oct. 12, 1976

[54] POWER SUPPLY

[75] Inventors: Edward J. Hart; James E. Leeman; Hugh R. MacDougall; John J. Marron, all of Albuquerque, N. Mex.; Calvin C. Smith, Amarillo, Tex.

[73] Assignee: The United States of America as represented by the United States Energy Research and Development Administration, Washington, D.C.

[22] Filed: Sept. 11, 1975

[21] Appl. No.: 612,394

[52] U.S. Cl. ..... 102/70.2 R; 102/28 EB; 89/8

[51] Int. Cl.[2] ..... F42B 3/14; F42D 7/00; F42C 19/12

[58] Field of Search ..... 89/9; 102/70.2, 28 EB; 310/20

[56] References Cited

UNITED STATES PATENTS

| | | | |
|---|---|---|---|
| 2,575,071 | 11/1951 | Rockwell | 102/70.2 R |
| 2,713,308 | 7/1955 | Brown et al. | 102/70.2 R |
| 2,900,908 | 8/1959 | Burrell | 102/70.2 R |
| 3,000,313 | 9/1961 | Lareau et al. | 102/70.2 R |
| 3,484,627 | 12/1969 | Conger et al. | 89/8 |

*Primary Examiner*—Samuel W. Engle
*Assistant Examiner*—Thomas H. Webb
*Attorney, Agent, or Firm*—Dean E. Carlson; Dudley W. King; Ignacio Resendez

[57] ABSTRACT

An electric power supply employs a striking means to initiate ferroelectric elements which provide electrical energy output which subsequently initiates an explosive charge which initiates a second ferroelectric current generator to deliver current to the coil of a magnetic field current generator, creating a magnetic field around the coil. Continued detonation effects compression of the magnetic field and subsequent generation and delivery of a large output current to appropriate output loads.

11 Claims, 10 Drawing Figures

FIG. 1
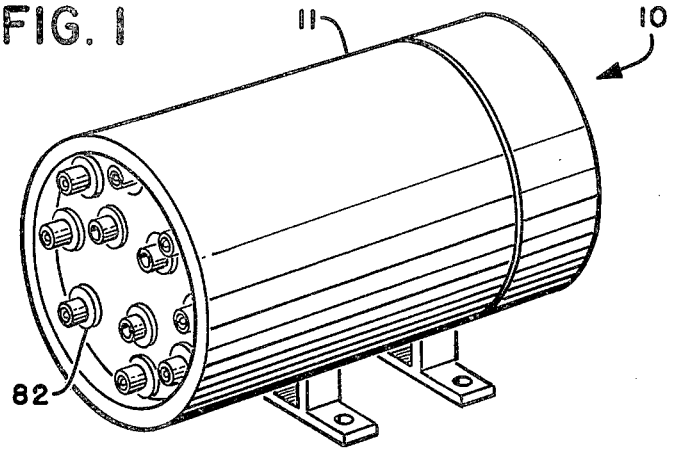
FIG. 2
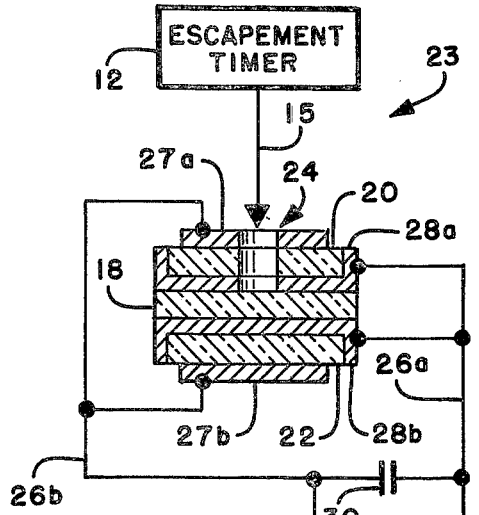
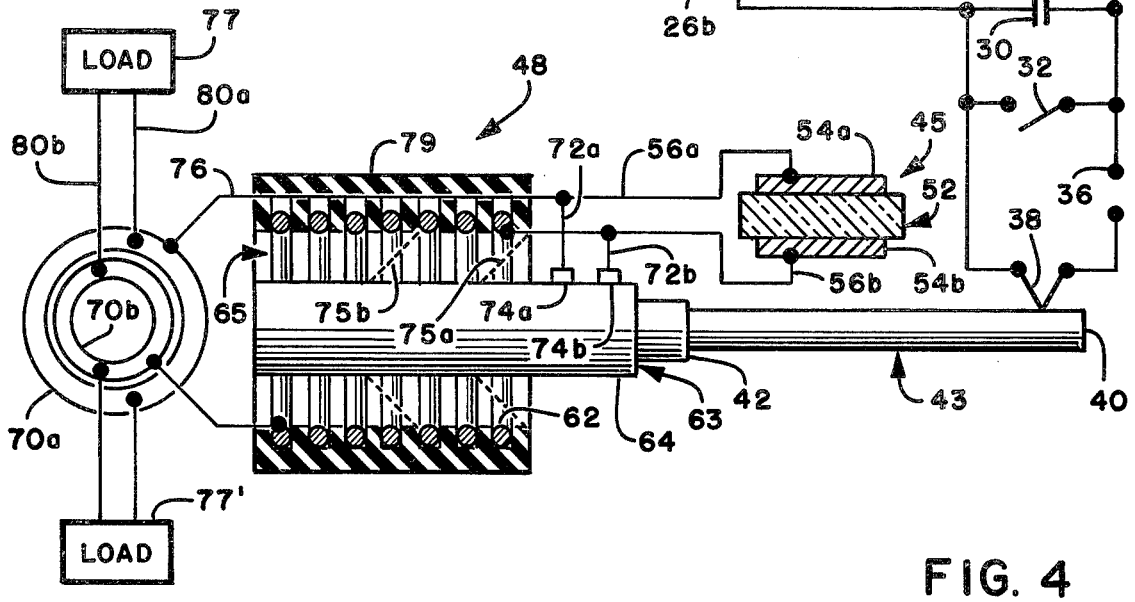
FIG. 4
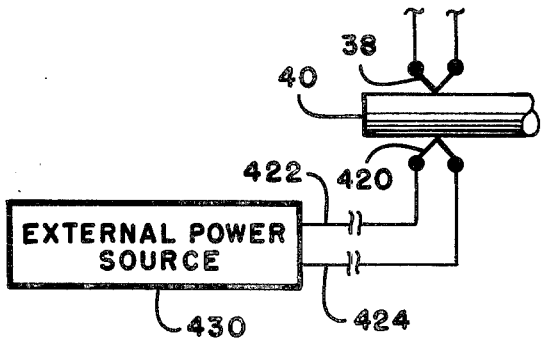
FIG. 5
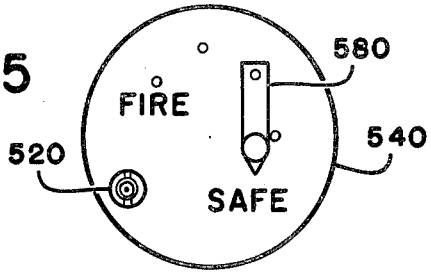
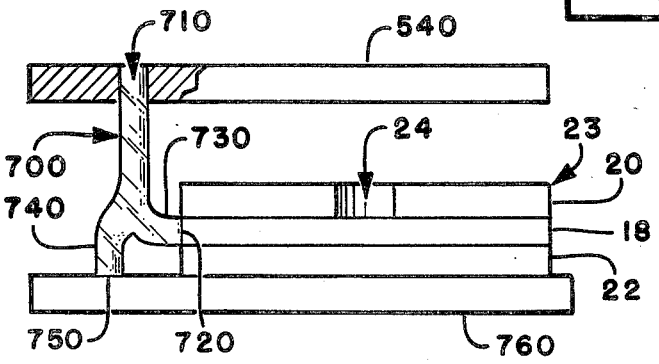
FIG. 7

POWER SUPPLY

BACKGROUND OF INVENTION

The invention relates to portable electric power supplies.

The power supply of this invention has a plurality of applications, such as supplying power to apparatus that will destroy or otherwise prevent the possession or use of a device, weapon or materials by unauthorized personnel and providing or supplying power to a built-in pyrotechnic or other system which, upon command, will damage or destroy the contents of a safe or other container or the like. This latter application may have value in initiating self-destruction in a number of containers or safes at once, such as in a ship or a building that is in danger of being compromised. Other potential applications include mining or other remote area operations where high power is required to initiate a large number of detonators which in turn ignite a large amount of explosives within a short time frame. The power supply of this invention provides much greater safety features than other current generation systems because it uses exploding bridgewire detonators containing secondary explosives rather than easily detonated blasting caps containing primary explosives. Other safety features include that the device or apparatus may be completely shielded so as to not be affected by lighting strokes, it is not operable by electromagnetic energy or mechanical shock, etc. Another safety feature is that since the power supply is designed to be self contained, there is minimun audible output or fragmentation so that people standing close to the power supply when it is activated are not injured.

Since the power supply of this invention may use exploding bridgewire detonators, it is particularly adaptable to application where timing of current output is required in the microsecond range succh as in stage ignition in rocket systems. This power supply may be used to activate a plurality of exploding bridgewires simultaneously at distances up to 1000 feet without difficulty.

Desirable features of a power supply capable of being employed for the above applications include that the apparatus be able to operate without external power or batteries; that the apparatus be manufactured at low cost and be able to fire, or supply power to fire, or otherwise activate a plurality of loads, such as about twenty loads; that the explosives or materials used in the apparatus be self-contained; that the apparatus be portable; that the apparatus be operable from a remote location and that the apparatus be able to be stored for long periods of time, such as about ten years, in the same environment as the systems which it is protecting without the requirement of periodic maintenance.

SUMMARY OF THE INVENTION

In view of the above, it is an object of this invention to provide a new combination of a first ferroelectric current generator with a second ferroelectric current generator and an explosively driven magnetic field current generator to provide an integrated power supply.

It is a further object of this invention to provide a self-contained, one man portable, expendable power supply capable of initiating a plurality of explosives or other electric components.

It is a further object of this invention to provide a power supply capable of providing over 400 amperes current for on the order of two microseconds to each of a plurality of loads, such as about twenty loads over cable lengths as long as 500 feet or 1000 feet.

It is a further object of this invention to provide a self contained novel power supply operable without external power and also operable from remote locations.

Various other objects and advantages will appear from the following description and the most novel features will be particularly pointed out hereinafter in connection with the appended claims. It will be understood that various changes in the details and materials as well as in the process steps which are herein described and illustrated in order to explain the nature of this invention may be made by those skilled in the art without departing from the scope of this invention.

The invention comprises an electrical power supply having means for fracturing a stressed glass ferroelectric-initiating element and means for converting strain energy released by the fracturing to electrical energy to initiate an explosive charge and effect current release from a second ferroelectric generator, which current is delivered to the coil of a current generator to create a magnetic field which is compressed via an expanding armature to generate a large output current.

DESCRIPTION OF DRAWING

FIG. 1 is a perspective view of an apparatus of this invention.

FIG. 2 illustrates in partially diagrammatic and partially cross-sectional fashion an embodiment of this invention.

FIG. 4 diagrammatically illustrates an alternate ignition mode.

FIG. 5 illustrates a plan view of an end of this apparatus.

FIG. 7 illustrates in partial cross-section and partial plan view, a light-pipe device for inspecting the condition of the stressed glass element.

DETAILED DESCRIPTION

An embodiment 10 of this invention, shown in perspective view in FIG. 1, may have an output of about 18,000 amperes for about 3 microseconds. Power supplies having this output and having a weight of about 35 pounds, length of about 18 inches and width of about 7 inches have been made using hollow, cylindrical housing 11 made of about one half inch thick aluminum alloys. Using the teachings of this invention, power supplies having more or less output likewise be provided.

Figure 3:
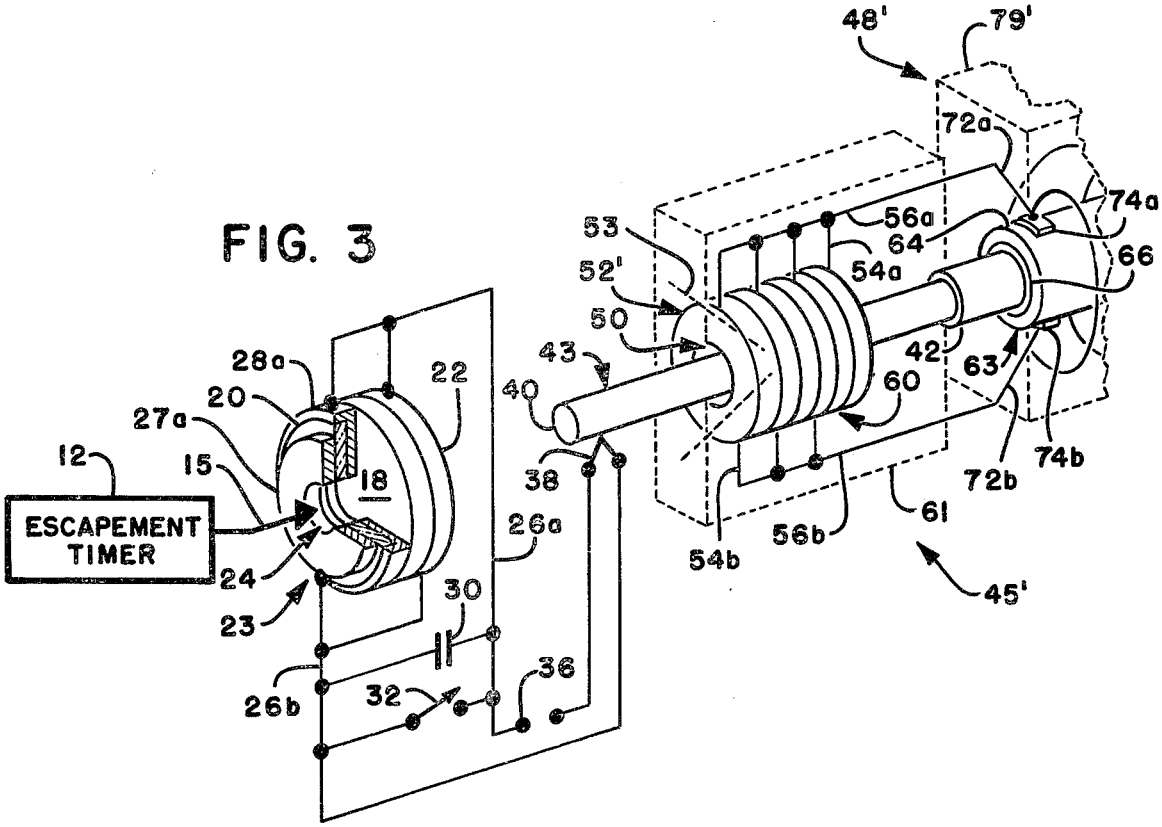
FIG. 3 further illustrates in partially diagrammatic and partially cross-sectional and perspective fashion a portion of an alternate embodiment.

The power supply shown in FIGS. 2 and 3 may include ferroelectric current generator 23, ferroelectric current generator 45(45') and magnetic field current generator 48(′). The power supply 10 may employ a suitable release mechanism, such as an escapement timer mechanism 12, which may be used to provide a variable delay period between activation of the escapement timer and movement or propulsion of the striking pin stabber or plunger 15 which acts similarly to a nail to deliver an impulse and fracture, shatter or otherwise break a stressed or strengthened glass-ceramic element, segment or disc 18 disposed adjacent and connected with electrically poled ferroelectric elements 20, 22 through appropriate means as described herein. It is preferred that disc 18 be in rigid mechanical connection with the elements to maximize coupling of the released strain energy from the glass-ceramic to the ferroelectric elements and to prevent sliding movement of the glass relative to the elements, which sliding movement would result in energy loss. For example, the rigid mechanical connection may be achieved by using a suitable adhesive such as an epoxy adhesive. It may be desirable to use a conductive epoxy adhesive, such as a silver containing epoxy, in order that the adhesive provide the mechanical bond and also act as one of the electrode as described hereinbelow. One skilled in the art will readily recognize that the discs, elements, electrodes, etc. shown in the drawings are grossly exaggerated in proportions for purposes of illustration.

The stabber or hammer 15 may be made of any suitable material but is preferably of tungsten carbide because of its hardness properties and the requirement that the stabber point fracture element 18. Although a plurality of separate ferroelectric elements could be placed on the fracturable element, maximum coverage of element 18 provides maximum strain on the poled ferroelectric elements and in turn provides maximum electrical energy output.

In the embodiments of FIGS. 2 and 3, disc 18 is disposed intermediate and contiguous with poled ferroelectric ceramic elements, sections or discs 20, 22. Ferroelectric disc 20 may have an opening or aperture 24 which allows the stabber or plunger 15 to strike the stressed disc 18, although other configurations may dispense with the aperture and strike disc 18 from other angles or sides. The element 18 should have such as the following properties: be capable of storing a large amount of strain energy, be frangible, and be capable of releasing a high percentage of the initial stored energy.

Fracture of the disc 18 releases strain energy which subjects the ferroelectric elements to a mixed radial and circumferential strain field by the rapid expansion of the shattering disc. This action upon the ferroelectric elements causes a potential across each element's electrodes which are connected in electrical parallel, and the current resulting from this potential is conducted therefrom by means of electrical conductors 26*a*, 26*b* to charge a capacitor 30 in an electrical circuit as shown in the drawing. As such, the shatterable element 18 and the ferroelectric ceramic discs 20, 22, together with appropriate electrodes as described below, coact to function as transducer or current generator 23.

Electrical conductors 26*a*, 26*b* may be connected or coupled in electrical parallel to positive electrodes 27*a*, 27*b* and negative electrodes 28*a*, 28*b*. These electrodes which are drawn thick solely for purposes of illustration, may be of any suitable material such as silver or nickel which may have been sputtered, plated or the like onto the ferroelectric surface of ferroelectric elements 20, 22 respectively. The ferroelectric ceramic material of elements 20, 22 may be any suitable well known material such as a lead-zirconate-titanate ceramic material.

A capacitor 30 of appropriate size, such as about 0.05 microfarads ($\mu f$), may be connected in electrical parallel to current generator 23 to store the electrical charge released. An appropriate safing switch 32 may also be connected in electrical parallel to current generator 23 to prevent undesired activation of power supply 10 when switch 32 is closed. However, when the escapement timer is activated through appropriate means to operate the power supply, switch 32 is opened to permit current passage to the detonator.

A suitable spark gap 36 may be disposed in the electrical circuit, such as in electrical series with electrical conductor 26*a*, to enable the capacitor to achieve an adequate state of stored energy to effect detonation of a detonator, and to aid in shaping the pulse produced by the current generator 23. When the capacitor 30 has been charged to a predetermined potential such as about 1300 volts ± 10 percent for the 0.05 $\mu f$ capacitor, spark gap 36 breaks down and delivers the stored energy to a suitable detonator 38 which may be a high energy exploding bridgewire detonator 38 such as a 0.9 by 10 mil gold/platinum bridgewire penetaerythritol tetranitrate (PETN) detonator or the like, thereby firing same. Fired detonator 38 then initiates explosive charge 40 which is contiguous to, adjacent to, or abuts explosive charge 42, both of which form explosive stick or train 43. The composition of explosive charge 40 may differ from the composition of explosive charge 42 in that explosive charge 40 may provide a lower detonation rate and output energy than charge 42. Of course, under some circumstance, both charges may have the same composition.

As shown in FIGS. 2 and 3, explosive stick 43, is used to explosively drive, in sequence, a ferroelectric current generator 45, 45′ and a magnetic field current generator 48, 48′. U.S. Pat. No. 2,827,851, which issued on Mar. 25, 1958 to P. B. Ferrara, and U.S. Pat. No. 2,691,159, which issued on Oct. 5, 1954 to J. D. Heibel, both illustrate the state of the art of ferroelectric current generators similar to generator 45. The ferroelectric current generator may be composed of one or more elements 52(52′), which are of any appropriate configuration to shape the current output pulse in order to achieve the required output. It may be desirable to employ a disc configuration in order to achieve a high efficiency conversion of high explosive energy to electrical energy, i.e., positioning the explosive charge within the disc hollow center as shown in FIG. 3 with FE current generator 45′, so that the disc is circumferentially disposed about the explosive charge. This provides maximum coupling of the explosive energy into the elements 52′ to depole same, and, in this application, shapes the current pulse to achieve the required output. Discs 52′ which are connected in electrical parallel, as illustrated in FIG. 3, may be washer shaped with the explosive charge 40 passing through the center of the opening or hole 50 of each disc 52′. Explosive charge 40 may be comprised of a plastic bonded explosive such as about 85% by weight of cyclotetramethylenetetranitramine (HMX) and about 15% by weight of a copolymer of vinyldene fluoride and perfluoropropene. It may be desirable to employ a plurality of ferroelectric discs 52′, such as about six ferroelectric discs having a suitable thickness, such as about 0.200 inches, with an inside diameter of about 1.00 inch and an outside diameter of about 2.500 inches. These discs may be formed from various known materials, e.g., polycrystalline ceramic of 95% lead zirconate-5% lead titanate which may have residual polarization levels suitable to provide the required current output level in conformity with the element used, and may suitably have a level of about 30 microcoulombs per square centimeter. It is to be understood that other dimensions, polarization values, material compositions and the like may also be employed. As is well known in the art, the residual polarization of these materials which comprise elements 52, 52' may typically be released as a free charge when the material is shocked above a predetermined pressure such as about 15 kilobars. As the explosive stick or train 43 burns down through the center hole 50 in discs 52', a radially directed cone-shaped shock wave is created, as indicated by dotted line 53 in FIG. 3, which sweeps through discs 52' and depoles the ceramic elements or discs and thereby releases the energy or charge from them, which energy then passes through the magnetic field current generator 48' by means of electrical conductors 56*a*, 56*b*. The effect of explosive train 43 burning past ferroelectric current generator 45 is the same as directed above for ferroelectric current generator 45' and energy is likewise released to magnetic field current generator 48.

Discs 52' may be suitably bonded together or retained isolated or spaced apart from each other as desired as long as they are maintained in a stable position relative to the explosive train. In the FIG. 3 embodiment, it may be preferred that discs 52' be adhesive bonded, such as with a suitable epoxy adhesive, to provide compactness and to minimize shock wave energy loss as the shock wave travels through adjacent discs. By maintaining the discs 52' in close contact as shown, the shock wave passes through a relatively homogeneous zone and the energy reducing release wave effect created when the shock wave meets material of different density is minimized. The released current or charge may be collected at contacts or electrodes 54*a*, 54*b* shown in FIG. 2, which electrodes are also disposed in similar fashion on the individual discs 52' of current generator 45'.

The edges or outer surface 60 of the discs 52' may be sealed, insulated and bonded with a suitable adhesive mixture, such as an epoxy adhesive-elastomer mixture, in order to prevent bridging of current or voltge between the adjacent electrodes. This adhesive-elastomer mixture then acts as an electrical seal yet possesses sufficient flexibility to provide for temperature variations without disrupting the electrical seal. The disc assembly or array may then be potted in a suitable dielectric material 61 such as an elastomeric potting material to permit thermal expansion and contraction of the discs without destroying the electrical seal on the edges 60. The epoxy adhesive-elastomer resin mixture bonds well to the ceramic elements, and the elastomer bonds well to this resin mixture, whereas the elastomer by itself may not provide the desired bond directly to the elements. To facilitate comprehension of the drawing, about half of the encapsulant potting material block, or retainer 61 is shown in phantom in FIG. 3. Contacts or electrodes 54*a*, 54*b*, may be made of suitable material such as 5 mil thick copper electrodes bonded by epoxy adhesive to the flat surfaces of the disc. Bonding procedures are known in the art.

The current produced by discs 52 builds to maximum amperage, of such as from about 400 to about 440 amperes depending upon the materials used in a very short time period, such as in about 10 microseconds, or less, such as about 6 microseconds. By this time, the explosive stick or train 43 continues ignition inside an explosively driven current generator 48, (48') of the sort described in, for example, *Journal of Applied Physics*, Vol. 39 No. 11, pages 5224–5231, October 1968, and this may comprise a single loop multiturn inductor or solenoidal coil 62 held concentric to an armature 63 having an outer conducting, concentric, hollow copper cylinder 64 disposed contiguous with and over a concentric, hollow aluminum tube or cylinder 66 filled with a high energy explosive 42. Detonation of the explosive charge at one end of the armature causes the armature 63 to be explosively expanded into a cone moving radially at a proportion, such as one third, of the explosive detonation velocity, through an air space 65 toward the solenoidal coil 62 to initially close appropriate switches such as shorting switches 72*a*, 72*b* which remove current generator 45 from the electrical circuit comprising the current generator 48, 48' and appropriate loads 77.

Although armature 63 could be made entirely of copper or other suitable material such as aluminum, it may be desirable to replace part of the copper cylinder or sleeve with an aluminum cylinder in order to achieve greater radial velocity since aluminum is light and will be displaced faster and the copper thickness required for electrical purposes is small. Aluminum may be used as the exclusive armature material but may be preferred to employ the copper-aluminum combination because copper has a higher electrical surface conductivity and offers less resistance to current flow. The armature wall thickness may range from about 0.010 to about 0.100 inches and preferably from about 0.035 inches to about 0.050 inches. Of this preferred range, the copper cylinder wall thickness may be from about 0.015 to about 0.025 inches. The aluminum hollow cylinder 66 may be placed within the copper hollow sleeve or cylinder 64 by heating the copper, cooling the aluminum, and placing the contracted aluminum cylinder within the expanded copper cylinder so that a shrink fit results at ambient temperature.

As shown in FIGS. 2 and 3, shorting switches 72*a*, 72*b* or the like switches my short out ferroelectric current generator 45, 45' when expanding armature 63 breaks or fractures electrical insulation pads or plates 74*a*, 74*b*, and is driven against the switches to electrically short out electrical conductors 56*a*, 56*b* moving the ferroelectric current generator 45, 45' from the circuit early in the operation of the explosively driven current generator 48, 48'. Discharge of ferroelectric current generator through the coil 62, load 77 and return or ground lead 76 creates an excitation current in the circuit and sets up a magnetic field in coil 62. The shorting switches 72*a*, 72*b* are closed at a predetermined delay interval so that the exciting current and magnetic field of the coil are at a maximum upon switch closure. The current returns from the load 77 on ground wire 76 which is disposed adjacent to the length of but not in contact with coil 62.

Closing of switches 72*a*, 72*b*, electrically shorts the ferroelectric current generator 45, 45' our of the circuit and a very gradual decay of the current in the magnetic field in coil 62 starts due to the large ratio of inductance to resistance in the circuit. This current establishes the initial field in the explosively driven current generator 48, 48'. The armature continues to expand, decreasing the inductance of the coil which results in an increase of the current, since the inductance-current product is maintained constant except for losses due to magnetic flux penetration into the coil and into the armature. As the armature expands further, it strikes the coil turns 62 and progressively removes them from the circuit by sweeping the coil turns 62 against the ground wire 76, to cause conduction between the coil and the ground wire. After the high excitation current or initial current is established in the generator coil, the expanding armature shorts out successive turns in said sweeping step as diagrammatically illustrated by lines 75*a*, 75*b* in FIG. 2, effecting efficient generation of electrical energy as known in the art. This results in a large decrease in inductance per unit time and a rapid increase or multiplication in the current in the load cables.

The driven current generator 48 unit generates a voltage by forcibly decreasing the circuit inductance due to armature movement. This voltage in turn produces the large output current. The inductance L of the single-layer solenoidal coil surrounding the armature is given by $$L = K\mu o N^2 A/l$$

where K depends on the geometry of the coil and is a function of wire diameter, coil diameter and coil length. The coil turns are equal to N, A is the area which the flux can occupy, $\mu o$ is the permeability of free space and l is the length of the coil.

The armature expansion decreases the inductance by first decreasing A, the area available to the flux, and later by removing turns from the circuit, decreasing N. Since within the limits of the losses that occur, the field energy is preserved and NQ (where Q is total effective flux linkage) is held equal to LI, then I must increase as L decreases. For example, an initial current of about 400 amperes may be multiplied to about 18,000 amperes in the load cables 80*a*, 80*b*. This current may then be used to fire the loads 77, 77' etc. which may be coupled to the terminal or output load rings 70*a*, 70*b*.

The magnetic field current generator may likewise be encapsulated or potted as indicated by encapsulant block or retainer 79, 79'. This encapsulating material may be any good electrical insulating material which has sufficient structural strength to retain the coil in position. Examples are such as mica-filled epoxy, polymerized methyl methacrylate or tetrafluoroethylene. The encapsulent retainer 79, 79' allows movement of the armature during expansion through air space 65 to contact coil 62 which subsequently contacts ground wire 76.

A power supply having the ferroelectric current generator component dimensions and ratings hereinabove recited, and which is capable of providing 18,000 amperes in the load cables, may have a current generator wherein the coil is wound of 70 turns of American wire gauge No. 26 heavy epoxy insulated wire wound at 56 turns per inch. The inner diameter of the coil may be about 1.2 inches and the outer diameter of the armature about 0.626 inches. The armature may be about 0.020 inch wall thickness hollow tube of oxygen free, high conductivity copper shrink fitted over a hollow tube of about 0.018 inch thickness of 2024 aluminum alloy. The explosive stick 42 may be a rod of PBX 9404 (plastic bonded explosive – 94% by weight of cyclotetramethylenetetranitramine (HMX) and 4% by weight of nitrocellulose), which rod is about 0.550 inch diameter by about 2.626 inches long and the explosive rod fits tightly inside the armature.

Table 1 summarizes results of various runs using an embodiment of the central power supply of this invention. Four currents representative of the operation are given for each run. Run 1 used 20 31 ohm coaxial cables, each 50 feet long, terminated in short circuits. Runs 2 and 3 used the same type of cables as run 1, but run 2 used a 1.5 mil by 20 mil gold bridgewire at the end of each cable and run 3 used a 1.5 mil by 40 mil gold bridgewire at the end of each cable.

It is evident from the results shown in the table that the central power supply can fire the 20 branches of 50 foot cables with plenty of current. Runs nos. 4 through 10 all employed 31 ohm coaxial cables and 1.5 mil by 20 mil gold bridgewire detonators, and each run used 20 cables, except run no. 6 which used 19 cables. Run no. 4 cable length was 25 feet, runs nos. 7, 9 and 10 cable lengths were 50 feet, run no. 5 cable length was 100 feet, run no. 8 cable length was 500 feet, and run six had 19 cables of varying lengths. Run no. 9 only used 2 bridgewire detonators (Results 1 and 2) and shorted out the other eighteen cables.

The embodiment herein described for which results are given, was intended to fire with 20 or more cables (e.g. 40 cables), and will fire the 1.5 mil by 20 mil explosive bridgewire detonator loads well when it sees a load impedance about the same as that provided by 20 cables or more in parallel. In order to avoid having to use 50 foot cables as "dummy" loads to achieve the desired impedance level when it is desired to fire only a few detonators, such as exploding bridgewire detonators, with the central power supply of this invention, load circuits may be used which simulate the impedance effect of a plurality of cables, i.e., that will simulate one, two, five or any number of 50 foot cables in parallel, the load circuits terminating in short circuits as illustrated in the table, runs 1 and 9.

TABLE

| Run | Number of Cables | Cable Length, Feet | BW* Size, mils | Burst Current (Amperes) 1 | 2 | 3 | 4 |
|---|---|---|---|---|---|---|---|
| 1 | 20 | 50 | (shorts) | 869 | 842 | 849 | 810 |
| 2 | 20 | 50 | 1.5 × 20 | 620 | 640 | 680 | 640 |
| 3 | 20 | 50 | 1.5 × 40 | 624 | 597 | 601 | 585 |
| 4 | 20 | 25 | 1.5 × 20 | 642 | 643 | 667 | 634 |
| 5 | 20 | 100 | 1.5 × 20 | 602 | 592 | 605 | 596 |
| 6 | 19 | Various | 1.5 × 20 | 375 | 588 | 680 | 507 |
| 7 | 20 | 50 | 1.5 × 20 | 600 | 565 | 538 | 538 |
| 8 | 20 | 500 | 1.5 × 20 | 492 | 468 | 501 | 488 |
| 9 | 20 | 50 | 2 at 1.5 × 20 18-shorts | BW-639 | BW-673 | 993 | 1035 |

booster on the output end of the MDF transfer assembly may be approximately ¼ inch in diameter. A suitable shaped charge may be such as 11.5 grams of RDX at 1.60 gm/cc over a 50° conical copper liner 139. Shaped charge 138 may be retained or confined by a casing 140 and further by a suitable plastic material such as polycarbonate resin container 141.

Detonation of shaped charge 138 results in a jet output of approximately 2 millimeters in diameter with tip velocity of about 6000 meters per second which passes through port 144 in end wall 105. Suppressor plug 147 is shown positioned below port 144. This plug is useful in supressing the effects of an unintended detonation of shaped charge 138 during storage, shipping, or the like. Plug 147 would be removed prior to attaching device 100 to as assembly which was to be rendered unusable or otherwise affected by the jet output of shaped charge 138.

Figure 9:
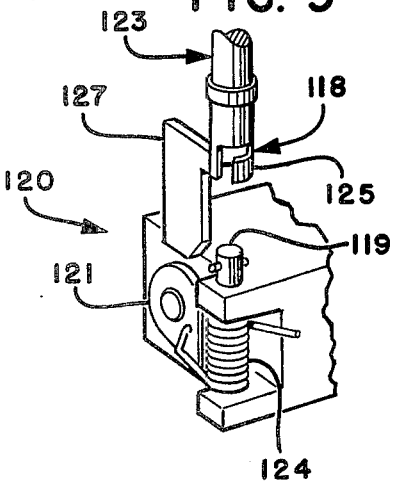
FIG. 9 illustrates in perspective cutaway view, the fired ignition means of the load shown in FIG. 8.

FIG. 9 illustrates a view of the fired ignition means 120 wherein slot 118 which had retained pin 119 is released therefrom. When release means 122 arming cylinder 125 is raised, shield 127 disengages striker 121, or is removed from striker 121 path, permitting striker 121 to strike or detonate percussion primer 122 and thereby initiate the explosive detonation as described hereinabove.

In an alternate remote operation mode for device 100 by current generated by the power supply 10 of this invention, use is made of electrical cable 150 housing a pair of electrical conductors which are electrically connected or coupled at one end of a suitable detonator such as an exploding bridgewire 157 or the like disposed adjacent to detonating train 130 and transfer charge assembly 134. Electrical cable 150 terminates at the other end at terminal 160 to which may be attached leads 80*a*, 80*b*, which may be further connected to output load rings 70*a*, 70*b* as shown in FIG. 2 or connectors 82 as shown in FIG. 1. The current generated by power supply 10 passes to exploding bridgewire or suitable detonator 157 and initiates the detonating train and the transfer charge assembly to further initiate shaped charge 138 as described hereinabove.

Figure 6:
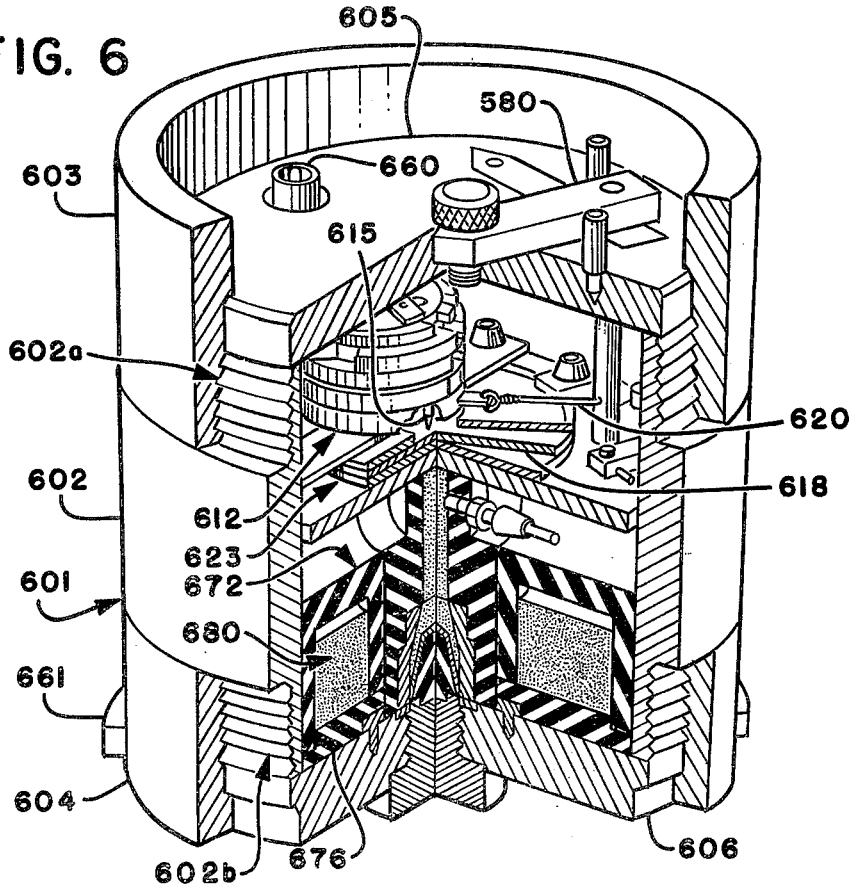
FIG. 6 illustrates in partial cross-section and perspective view, a load which may be used with the power supply of this invention.
Figure 10:
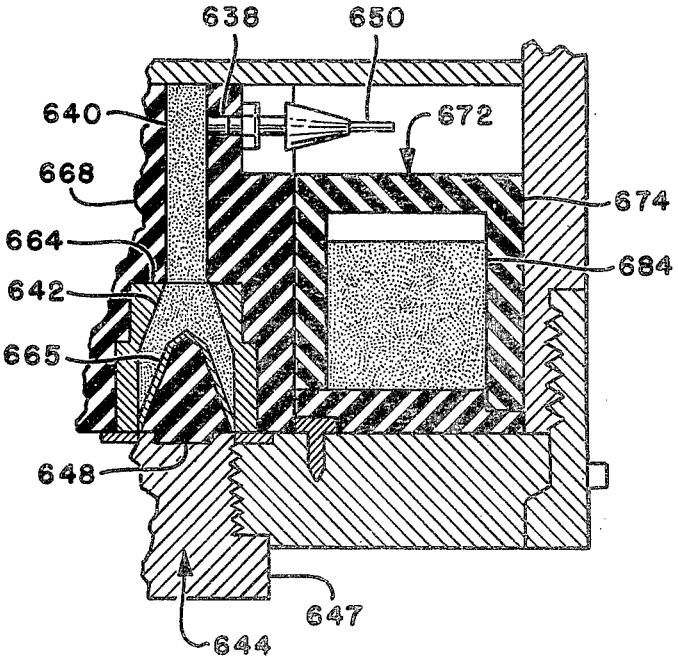
FIG. 10 illustrates in a cross-section cutaway view, a portion of the load of FIG. 6.

In the embodiment of FIGS. 6 and 10, the housing 601 may have an outer tubular wall 602 with threaded end portions 602*a*, 602*b*. Retaining end wall portions 603, 604 mate with threaded portions 602*a*, 602*b* respectively, to lock or otherwise retain end walls 605, 606 in position. As described hereinabove, as escapement timer 612, release means 580, stabber 615 and ferroelectric current generator 623 coact to generate current to ignite a detonator 638 through electrical cable 650, the detonator 638 being disposed adjacent an explosive charge or booster train 640. The electrical circuitry between the ferroelectric ceramic elements of the current generator 623 and the detonator 638 are as described for FIGS. 2 and 3.

Ignition of detonator 638 effects further ignition of the detonator train 640 and subsequent ignition of explosive shaped charge 642. Disposed opposite detonator 638 may be another detonator (not shown) which is generally positioned as illustrated for the power supply in FIG. 4, and which is appropriately connected using suitable electrical conductors, to terminal connector 660. This connection provides for the external or remote activation of this device using an electrical power supply of this invention.

The device of FIG. 6 may be 6.25 inches long and 6 inches in diameter. The flanges 661 at the bottom of the device lock the device into mating pads on the component that is to be disabled. The mating pads in turn may be permanently mounted on the component to be disabled, or may be appropriately strapped or otherwise attached to said component. The flanges may be about 6.50 inches outer diameter. The device, using a suitable aluminum alloy, may weight about 11 pounds and contain about 6.3 grams of secondary explosive (i.e. such as 5.5 grams in the shaped charge 642 and 0.8 grams in the detonator train and two exploding bridgewire detonators). Suppressor plug 647 may be disposed adjacent a plastic explosion suppressant 648 to reduce the effect of an undesired detonation. Both plug 647 and suppresant 648 are removed prior to mounting on a using device. The explosive 642 is retained or confined by a casing 664 and further by a suitable plastic material, such as polycarbonate resin container 668. Circumferentially disposed about container 668 is a housing 672 made of a suitable foam material such as polystyrene. The housing 672 upper portion 674 and bottom cover 676 described a volume or chamber 680 which may contain a suitable flame suppressant 684 such as the reaction product of potassium bicarbonate and urea (i.e., a carbamic product). This flame supresant is used to suppress flames present at the device-component interface. It is feasible to employ flame suppresant compacts of carbamic product, low-binder-content microballon syntactic foams, epoxy - sodium bicarbonate powder, epoxy - sodium bicarbonate - microballon compacts, and many others, in lieu of housing 672 containing the reaction product of potassium bicarbonate and urea.

The light pipe device of FIG. 7 may also be used in the device of FIG. 6 to determine the condition of the stressed glass-ceramic element – i.e. – whether broken or not.

When the current generator 623 is employed to fire the FIG. 6 device (internal mode operation), this ferroelectric current generator 623 may be electrically connected to a coaxial detonator 638 containing a 0.9 mil by 10 mil gold/platinum 70/30 composition bridgewire which is coupled with such as 16,000 to 20,000 $cm^2/gm$ heat stabilized PETN. The PETN is initially pressed to $0.80 + 0.02$ gm/cc and $-0.00$ gm/cc, and may interface a PETN output pellet that has been pressed to $1.65 \pm 0.02$ gm/cc, which is coupled to the shaped charge booster train.

In the externally-fired mode, the detonator may also be a coaxial detonator but may contain a 1.5 mil by 20 mil gold bridgewire coupled with 5000 to 8000 $cm^2/gm$ PETN pressed to $0.88 \pm 0.02$ gm/cc, and interfaced with the above PETN output pellet.

The shaped charge 642 may be such as 11.5 grams of RDX pressed to about $1.65 \pm 0.05$ gm/cc disposed within a case 664 and having a pressed copper liner 655 adjacent and contiguous with its bottom side. Initiation of the shaped charge creates a shaped jet which passes through port 644 into the component to be disabled. Suppressor plug 647 shown positioned within port 644 is useful in suppressing the effects of an unintended detonation of shaped charge 642 during storage, shipping or the like, and would be removed prior to emplacement in the using component.

A light pipe device 700 (FIG. 7) which extends to the outside of the power supply casing such as through top plate 540 through an aperture or port 710 as well as to an appropriately coated or silvered surface 720 of the stressed glass-ceramic element 18, may be employed to TABLE-continued

| Run | Number of Cables | Cable Length, Feet | BW* Size, mils | Burst Current (Amperes) 1 | 2 | 3 | 4 |
|---|---|---|---|---|---|---|---|
| 10 | 20 | 50 | 1.5 × 20 | 662 | 664 | 640 | 591 |

*BW = bridgewire

As shown in FIG. 4, power supply 10 may incorporate another detonator 420 such as exploding bridgewire detonator adjacent explosive charge 40. Detonator 420 may be coupled through electrical conductors 422 and 424 to a remote or external power source 430 which may be another power supply of this invention described above so as to result in a pyramid effect by detonating a large number of loads connected with a plurality of power supplies which are activated from one power supply. using combinations of this type, a large number of loads, such as 400, may be activated from one power supply. It may be desirable to couple conductors 422, 424 to a connector plug 520 on an end wall 540 of a power supply as shown in FIG. 5.

Various compositions of bridgewire and explosives may be used. For example, the exploding bridgewire detonator 38 may be a 0.9 mil diameter *x* 10 mil long gold/platinum 70/30 composition bridgewire coupled with an explosive charge which may be 16,000—20,000 square centimeters per gram ($cm^2/gm$) pentaerythritol tetranitrate (PETN) pressed to 0.80 + 0.02 and −0.00 grams per cubic centimeter (gm/cc) that has been properly aged and processed, which may be in turn be coupled to an output pellet which may be PETN pressed to about 1.65 ± 0.02 gm/cc. Detonator 420 may be a 1.5 mil by 20 mil gold bridgewire detonator coupled with 5,000 to 8,000 $cm^2/gm$ PETN pressed to 0.88 ± 0.02 gm/cc and interfaced with an explosive charge which may be a PETN output pellet or charge that may have been pressed to about 1.65 ± 0.02 gm/cc.

Figure 8:
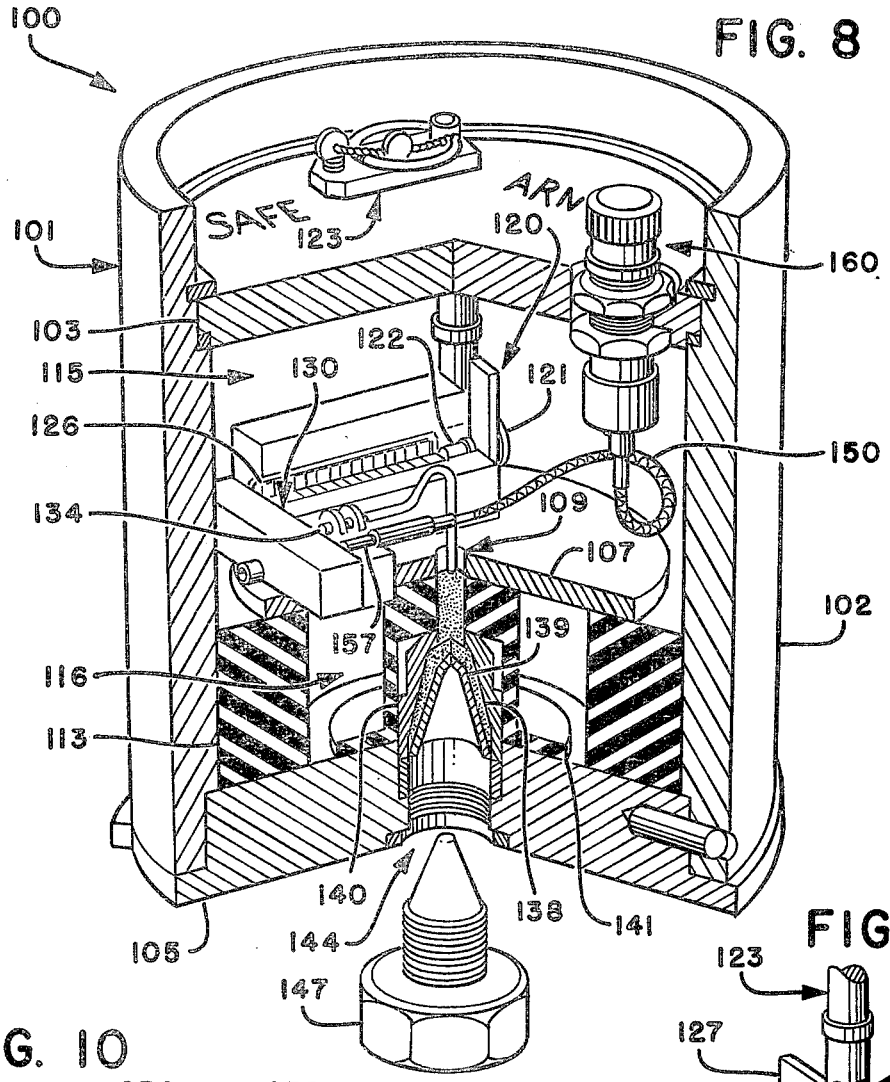
FIG. 8 illustrates in partial cross-section and perspective view, another load design which may be used with this invention.

Various types of escapement timers may be employed in the power supply of this invention. Various utilization devices such as emergency disablement devices as illustrated in FIGS. 6 and 8, may be used with this invention. One design incorporates a lever 580 (FIG. 5) which is rotated from the safe position of the fire position. It may be desirable to incorporate a ratchet mechanism (not shown) or the like to lock the lever in the fire position and prevent its return to the safe position. This rotation action opens safing switch 32 and also pulls a connector such as a lanyard wire (620-FIG. 6) which starts an escapement timer to run for a suitable time such as about 15 seconds. This delay time enables the operator to move away from the power supply or from the load as the case may be. When the timer runs down, it releases a spring loaded or otherwise biased pin 615 (15 in the case of the power supply of FIGS. 2 and 3) to fracture the stressed glass-ceramic disc 618 which is attached to the ferroelectric ceramic elements and generate the electrical current which activates the detonators as previously described.

The power supply described herein is a power multiplier which may be used to prevent the use or information of devices and classified data or the like from falling into the hands of unauthorized personnel, by incorporating this power supply in a safe or other secure container system which upon command will destroy the contents of the container with a built-in pyrotechnic system. The power supply may be designed to generate sufficient current to fire a plurality of loads 77, or, as an alternative, these loads may actually comprise additional power supplies to create a pyramid effect so that the total number of the loads to which power is supplied is extensively increased.

Various options with this power supply are open to operators who want to use simultaneous emergency denial of a number of devices. Thus a plurality of loads which may be located within a secure container system or the like, or strapped thereto using appropriate material such as nylon webbing, or otherwise attached thereto, may be electrically connected by conductors 80*a*, 80*b* to connectors or terminals 82 shown in FIG. 1 at one end of power supply 10, which in turn may be electrically coupled to such as load rings 70*a*, 70*b*. Load 77 may comprise an emergency disablement or destruct device shown in FIGS. 6 and 8. These devices, which contain a shaped charge and which can be attached externally to a secure container or other devices or mechanism without significant design modification by appropriate means such as by strapping the load directly onto the container or other mechanism using nylon webbing or other appropriate tie-down material, or by direct attachment such as by employing mounting lugs 661, may be manually or remotely operable using the power supply of this invention.

The apparatus 100 of FIG. 8 may have a housing 101 comprising outer tubular wall 102 closed by end walls 103, 105. A flat, washer-like plate 107 having an opening or aperture 109 and being in outer peripheral contact with a generally tubular foam fragment absorber 113 may divide the space within housing 102 into a pair of chambers 115, 116. In one mode of operation, ignition means 120 may comprise a striker 121 and percussion primer 122. Upon release of the striker by activation of release means 123 to release biasing means 124 such as a torsion spring (FIG. 9), the striker 121 strikes the percussion primer 122 and ignites a pyrotechnic delay detonator 126 which may be suitably designed to provide a lapse of time, such as about 30 seconds, adequate to permit the operator to move away from the area. The delay detonator may contain such as a percussion primer 122, a suitable quantity of delay powder such as about 5.5 grams of tungsten delay powder, an explosive charge such as about 125 milligrams of lead azide, and a suitable base charge of such as about 80 milligrams of cyclotrimethylenetrinitramine (RDX) which thereafter initiates a detonating train 130 which is made of a suitable material such as an aluminum sheath ribbon mild detonating fuse (MDF) which may be about 0.065 inches thick and about 1.9 inches long, which ribbon abuts an explosive transfer charge assembly 134 which may be a length of 2 grain per foot mild detonating fuse e.g., lead sheath with PETN and a suitable binder inside, with a hexanitrostilbene booster charge crimped at each end, and which subsequently initiates shaped charge 138 within chamber 116. The inform an operator whether the current generator 23 sandwich is intact or has been fired. When the transducer is intact, light entering the light pipe from the top plate exterior may be reflected by silvered surface 720 on the circumferential edge of the stressed glass element 18 adjacent an end of leg or branch 730 of light pipe device 700. If the tranduscer has been fired, whether by intention spontaneous failure, or sabotage, no light will be reflected.

It may likewise be desirable to incorporate into a wall of the housing of the power supply or other using devices, piston shaped means (not shown) which are recessed under ordinary circumstances. If the explosive charge is detonated for some reason, the gas buildup and expansion pressure within the housing would force the piston to protrude to a higher position to permit a visual observation and determination of detonation. Since the power supply is self contained, it may not be otherwise possible to determine if the central power supply explosives have been discharged or not.

The light pipe device 700 may, alternatively, have another leg 740 extending to an appropriately coated surface 750, such as a silvered surface, on an insulative back-up plate 760 or the like. This facilitates inspection to see if the glass surface is broken by using a fiber light pipe wherein leg 740 is bonded to the insulator plate 760 and silvered surface 750 as a reference and the other leg 730 to the glass element 18 silvered surface 720. If intact, light is evenly reflected. If the glass element 18 is broken by failure or the like without denotation, one half of the light pipe will show a smooth reflection from the reference surface but the other half (i.e. – through leg 730) will not indicate light reflection because of the broken glass surface. If the power supply is explosively detonated, there will be no reflection since the stressed glass element 18 silvered surface 720 will be shattered.

It may be desirable to place a lock-out cover (not shown) over the top plate of the power supply in order to prohibit or retard entry and arming of the firing mechanism by unauthorized personnel. the type of lock that is employed may be any various types used in the art such as a push-button combination lock.

what is claimed is:

1. An electric power supply comprising first and second ferroelectric current generators; a magnetic field current generator; means for delivering an impulse to and activating said first ferroelectric current generator to generate a first electric current; means including a detonator and an explosive adjacent both said second ferroelectric generator and said magnetic field generator for employing said first electric current and activating said second ferroelectric current generator and generating a second electric current; means for coupling said second electric current to said magnetic field current generator, said magnetic field current generator generating a third electric current in response to activation of said explosive; and means for coupling said third electric current to an output terminal.

2. The apparatus of claim 1 wherein said first ferroelectric current generator comprises a ferroelectric ceramic element and a stressed glass-ceramic element in contact with said ferroelectric ceramic element and a pair of spaced electrodes in electrical contact with said ferroelectric ceramic element and coupled to said second ferroelectric current generator, said stressed glass-ceramic element and said ferroelectric ceramic element coacting to convert energy released by said stressed glass-ceramic element upon delivery of said impulse fracturing said stressed glass-ceramic element to said first electric current, which current is delivered through said pair of electrodes to said second generator.

3. The apparatus of claim 1 wherein said first ferroelectric current generator impulse delivering and activating means comprises an escapement timer, a fracturing member, means for propelling said fracturing member against said stressed glass-ceramic disc to fracture said glass-ceramic disc, and said escapement timer coacts with said propelling means to delay said fracture.

4. The apparatus of claim 3 wherein a first pair of electrical conductors is provided for conducting said first electric current from said first ferroelectric current generator to said detonator.

5. The apparatus of claim 4 further including another detonator adjacent said explosive, a second pair of electrical conductors for receiving a remotely generated electric signal for activating said another detonator and wherein said detonator and said another detonator are exploding bridgewire detonators and said fracturing member is pointed tungsten carbide member.

6. The apparatus of claim 4 together with a capacitor disposed in electrical parallel with said first ferroelectric current generator, a safing switch disposed in electrical parallel with said first ferroelectric current generator, said safing switch being closed prior to activation and open subsequent to activation of said first ferroelectric current generator to prevent undesired detonation of said detonator, and a spark gap disposed in electrical series on one of said second pair of electrical conductors intermediate said capacitor and said detonator.

7. The apparatus of claim 4 wherein said second ferroelectric current generator comprises an electrically poled ferroelectric element, a pair of electrodes in contact with said poled ferroelectric element, said detonation of said explosive effecting passage of a shock wave through said poled ferroelectric element to depole same and generate said second electric current.

8. The apparatus of claim 1 wherein said ferroelectric current generator comprises a plurality of poled, contiguous circular ferroelectric discs which form a hollow cylindrical second ferroelectric current generator, a plurality of electrodes disposed in contact with each of said contiguous ferroelectric elements for removing said second electric current; said explosive is of elongated configuration and partly disposed within the hollow portion of said hollow cylindrical second ferroelectric current generator, and said detonation of said explosive effects a radial shock wave which radially depoles said hollow, cylindrical second ferroelectric current generator releasing electrical energy as said second electric current.

9. The apparatus of claim 1 wherein said magnetic field current generator includes a armature of hollow cylindrical configuration, said means for activating said magnetic field current generator includes a portion of said explosive disposed adjacent said armature, said means for coupling said second electric current to said magnetic field current generator comprises a third pair of electrical conductors in electrical contact with said second ferroelectric current generator, one of said third pair of electrical conductors being concentrically disposed as a coil about said armature and in radially outwardly spaced relation thereto, the other of said electrical conductors being adjacent to and transversely spaced from said concentrically disposed coil, said third pair of electrical conductors being electrically coupled to said output terminal, initiation of said explosive being effected generally concurrently with passage of said second electrical current to said coil to establish a magnetic flux field about said armature, said actuated explosive effects a progressive expansion of said armature into contact with said coil along the length of said coil and compresses said magnetic flux field, said expansion effecting contact of said coil to the other of said third pair of electric conductors, said progressive contact of said armature with said coil results in progressive removal of said contacted coil from the circuit and increases the magnitude of said third electric current to said output terminal.

10. The apparatus of claim 9 wherein said armature comprises a pair of elongated tubular members, one of said pair being of copper and the other of aluminum, and said aluminum member is disposed within and contiguous to said copper member.

11. The apparatus of claim 6 wherein said second ferroelectric current generator comprises a plurality of poled, contiguous, circular ferroelectric discs, electrodes disposed in contact with each of said contiguous ferroelectric discs for removing said second electric current, said explosive has a first portion disposed within the hollow portion of said hollow cylindrical second ferroelectric current generator, and said detonation of said explosive charge effects a radial shock wave which radially depoles said hollow, cylindrical second ferroelectric current generator releasing electrical energy as said second electric current; means for coupling said second electric current to said magnetic field current generators, said magnetic field current generator includes an armature comprising an elongated tubular member, said means for activating said magnetic field current generator includes a second portion of said explosive disposed adjacent said armature, said means for coupling said second electric current to said magnetic field current generator comprises a third pair of electrical conductors in electrical contact with said second ferroelectric current generator, one of said third pair of electrical conductors being concentrically disposed as a coil about said armature and in radially outwardly spaced relation thereto and the other adjacent to and transversely spaced from said concentrically disposed coil, said third pair of electrical conductors being electrically coupled to said output terminal, initiation of said explosive being effected generally concurrently with passage of said second current to said coil to establish a magnetic flux field about said armature, said actuated explosive effects a progressive expansion of said armature into contact with said coil along the length of said coil and compresses said magnetic flux field, said expansion effecting contact of said coil to the other of said third pair of electrical conductors, said progressive contact of said armature with said coil results in progressive removal of said contacted coil from the circuit and increases the magnitude of said third electric current, a shorting switch disposed on each of said third pair of electrical conductors such that expansion of said armature electrically shorts out said second ferroelectric current generator subsequent to passage of said second electric current into said magnetic field current generator creating said magnetic flux field.

* * * * *